US011469091B1

(12) United States Patent
Fisher et al.

(10) Patent No.: US 11,469,091 B1
(45) Date of Patent: Oct. 11, 2022

(54) MASS SPECTROMETER APPARATUS INCLUDING ION DETECTION TO MINIMIZE DIFFERENTIAL DRIFT

(71) Applicant: PerkinElmer Health Sciences Canada, Inc., Woodbridge (CA)

(72) Inventors: William Fisher, Cookstown (CA); Bohdan Atamanchuk, Mississauga (CA); Hamid R. Badiei, Woodbridge (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 0 days.

(21) Appl. No.: 17/245,082

(22) Filed: Apr. 30, 2021

(51) Int. Cl.
*H01J 49/40* (2006.01)
*H01J 49/00* (2006.01)
*H01J 49/02* (2006.01)

(52) U.S. Cl.
CPC ..... *H01J 49/40* (2013.01); *H01J 49/0031* (2013.01); *H01J 49/0036* (2013.01); *H01J 49/022* (2013.01); *H01J 49/025* (2013.01)

(58) Field of Classification Search
CPC .... H01J 49/40; H01J 49/0031; H01J 49/0036; H01J 49/022; H01J 49/025
USPC ..... 250/283, 397
See application file for complete search history.

(56) References Cited

U.S. PATENT DOCUMENTS

| | | | | |
|---|---|---|---|---|
| 4,472,630 | A | 9/1984 | Schoen | |
| 5,463,219 | A | 10/1995 | Buckley et al. | |
| 7,220,970 | B2 | 5/2007 | Rottmann et al. | |
| 7,745,781 | B2 | 6/2010 | Steiner | |
| 9,530,632 | B2 | 12/2016 | Kholomeev et al. | |
| 10,074,528 | B2 | 9/2018 | Makarov et al. | |
| 10,794,879 | B2 | 10/2020 | Verenchikov | |
| 2002/0175292 | A1 | 11/2002 | Whitehouse et al. | |
| 2006/0020400 | A1 | 1/2006 | Okamura et al. | |
| 2014/0097338 | A1* | 4/2014 | Eiler | H01J 49/04 250/288 |
| 2019/0259591 | A1 | 8/2019 | Kobayashi et al. | |
| 2019/0259594 | A1 | 8/2019 | Kobayashi et al. | |
| 2019/0348265 | A1 | 11/2019 | Steiner et al. | |
| 2020/0066502 | A1 | 2/2020 | Bevis et al. | |
| 2020/0105512 | A1 | 4/2020 | Steiner et al. | |
| 2020/0194246 | A1 | 6/2020 | Sheils et al. | |

FOREIGN PATENT DOCUMENTS

| | | | |
|---|---|---|---|
| WO | 9850941 | A1 | 11/1998 |

* cited by examiner

*Primary Examiner* — Kiet T Nguyen
(74) *Attorney, Agent, or Firm* — Myers Bigel, P.A.

(57) ABSTRACT

A mass spectrometry apparatus includes an ion detector and a control circuit coupled to the ion detector. The ion detector includes a pulse counting stage and an analog stage configured to generate a pulse counting signal and an analog signal, respectively, responsive to incident ions. The a control circuit is configured to output the pulse counting signal in a pulse counting output mode and to output the analog signal in an analog output mode. The control circuit is configured to switch from the pulse counting output mode to the analog output mode responsive to the pulse counting signal exceeding a first threshold within a range of about 10 million counts per second to about 200 million counts per second. Related devices and operating methods are also discussed.

32 Claims, 7 Drawing Sheets

MASS SPECTROMETER APPARATUS INCLUDING ION DETECTION TO MINIMIZE DIFFERENTIAL DRIFT

BACKGROUND

Mass spectrometry is an analytical method that measures the mass-to-charge ratio of ions. Various data acquisition systems are used in mass spectrometry. One such system that may be used in inductively coupled plasma mass spectrometry (ICP-MS) is the electron multiplier detector, which detects ions impinging on its dynodes and amplifies the resultant signal to a usable level. For example, an ion detector may include an electron multiplication mechanism that generates secondary electrons in response to incident ions, and cascade-multiplies the generated secondary electrons up to a detectable level to thereby generate an electrical signal corresponding to the amount of ions.

Electron multipliers can operate in a pulse count mode or an analog mode of operation. Conventionally, electron multipliers can be configured to operate in pulse count mode and/or analog mode, depending on the situation. Such multi-mode ion detectors (also called simultaneous mode electron multipliers) may be used to detect signals to realize both high count rates and wide dynamic range.

As an example of such a multi-mode ion detector, U.S. Pat. No. 5,463,219 describes a dual mode ion detector in which an electron multiplication mechanism includes multiple stages, each including multiple dynodes, and two output ports at different positions of the electron multiplication mechanism. One stage is referred to as an analog stage, which generates an electrical signal at a lower electron multiplication factor or gain. The output of this analog signal may be referred to as an analog output mode. The other stage is referred to as a pulse counting stage, which generates an electrical signal indicating an electrical pulse count after electron multiplication at a higher electron multiplication factor or gain. The output of this pulse counting signal may be referred to as a pulse counting (or "digital") output mode. A dual-mode ion detector may thus be capable of operating in both a pulse counting and analog output modes and may select which stage to use as the output (also referred to as the counting port and the analog port, respectively) for detection purposes.

Inductively coupled plasma (ICP) mass spectrometers may provide among the widest signal dynamic range of all current mass spectrometry instruments (typically over 9 orders of magnitude). As noted above, dual mode (or "dual stage") ion detectors may be used, with the pulse counting stage handling ion count rates of up to about 5 million counts/second, and the analog stage handling larger signals, adding an additional 2 to 3 orders of magnitude of signal measurement capability. The signals from the two separate stages may be combined using instrument hardware and/or software to perform "cross-calibration" operations to achieve an accurate matching or "crossover" of the signals from the two stages.

SUMMARY

According to some embodiments, a mass spectrometry apparatus includes an ion detector comprising a pulse counting stage and an analog stage configured to generate a pulse counting signal and an analog signal, respectively, responsive to incident ions; and a control circuit coupled to the ion detector. The control circuit is configured to output the pulse counting signal in a pulse counting output mode, and to output the analog signal in an analog output mode. The control circuit is configured to switch from the pulse counting output mode to the analog output mode responsive to the pulse counting signal exceeding a first threshold. The first threshold is within a range of about 10 million counts per second to about 200 million counts per second.

In some embodiments, the first threshold may be within a range of about 30 million counts per second to about 150 million counts per second.

In some embodiments, the control circuit may be configured to correct an accuracy of the pulse counting signal using a correction factor, and may be configured to switch from the pulse counting output mode to the analog output mode based on the correction factor.

In some embodiments, the correction factor may be based on a dead time of the pulse counting signal, and the control circuit may be configured to switch from the pulse counting output mode to the analog output mode when the correction factor is about 1.5 or more.

In some embodiments, the ion detector and/or the control circuit may be configured to provide the pulse counting signal having a pulse width of less than about 5 nanoseconds at about half of a pulse amplitude of the pulse counting signal.

In some embodiments, the ion detector and/or the control circuit may be configured to provide the pulse width of less than about 5 nanoseconds at about a tenth of the pulse amplitude.

In some embodiments, the pulse counting signal may have an output current of greater than about 30 microamperes.

In some embodiments, a charge transfer capability of the ion detector may be greater than about 1 coulomb.

In some embodiments, the analog stage may be configured to provide a first gain, and the pulse counting stage may be configured to provide a second gain that is two or more orders of magnitude higher than the first gain.

In some embodiments, the analog stage may include a first plurality of dynodes, and the pulse counting stage may include at least one avalanche diode.

In some embodiments, the control circuit may be configured to reduce the second gain of the pulse counting stage or deactivate the pulse counting stage responsive to the analog signal exceeding a second threshold that is greater than the first threshold.

In some embodiments, the control circuit may be configured to prevent cross-calibration of the pulse counting and analog signals responsive to the pulse counting signal indicating less than about $2\times10^5$ counts per second.

In some embodiments, the apparatus may further include a quadrupole mass analyzer in an ion path between an ion source and the ion detector.

In some embodiments, the mass spectrometry apparatus may be an inductively coupled plasma system.

In some embodiments, the first threshold may be based on an accuracy of the pulse counting signal and may be independent of an accuracy of the analog signal.

According to some embodiments, an apparatus includes an ion detector comprising a pulse counting stage and an analog stage configured to generate a pulse counting signal and an analog signal, respectively, responsive to incident ions; and a control circuit coupled to the ion detector. The control circuit is configured to output the pulse counting signal in a pulse counting output mode, and to output the analog signal in an analog output mode. The control circuit is configured to correct an accuracy of the pulse counting signal using a correction factor, and is configured to switch from the pulse counting output mode to the analog output mode based on the correction factor.

In some embodiments, the control circuit may be configured to switch from the pulse counting output mode to the analog output mode responsive to the correction factor exceeding a threshold, where the threshold may be about 1.5 or more.

In some embodiments, the threshold may be about 2.5 or more.

In some embodiments, the threshold may be based on a dead time of the pulse counting signal.

In some embodiments, the threshold may correspond to a corrected pulse count rate within a range of about 10 million counts per second to about 200 million counts per second.

In some embodiments, the ion detector and/or the control circuit may be configured to provide the pulse counting signal having a pulse width of less than about 5 nanoseconds at about half of a pulse amplitude of the pulse counting signal, and the threshold may be based on the pulse width.

In some embodiments, the correction factor may be independent of an accuracy of the analog signal.

According to some embodiments, a method includes performing, by a control circuit, operations comprising receiving, from an ion detector, pulse counting and analog signals generated by pulse counting and analog stages thereof, respectively, responsive to incident ions; and switching from a pulse counting output mode for output of the pulse counting signal to an analog output mode for output of the analog signal responsive to the pulse counting signal exceeding a first threshold. The first threshold is within a range of about 10 million counts per second to about 200 million counts per second.

In some embodiments, the first threshold may be within a range of about 30 million counts per second to about 150 million counts per second.

In some embodiments, the control circuit may be configured to correct an accuracy of the pulse counting signal using a correction factor, and may be configured to switch from the pulse counting output mode to the analog output mode based on the correction factor.

In some embodiments, the correction factor may be based on a dead time of the pulse counting signal, and the control circuit may be configured to switch from the pulse counting output mode to the analog output mode when the correction factor is about 1.5 or more.

In some embodiments, the ion detector and/or the control circuit may be configured to provide the pulse counting signal having a pulse width of less than about 5 nanoseconds at about half of a pulse amplitude of the pulse counting signal.

In some embodiments, the pulse counting signal may have an output current of greater than about 30 microamperes.

In some embodiments, a charge transfer capability of the ion detector may be greater than about 1 coulomb.

In some embodiments, the analog stage may be configured to provide a first gain, and the pulse counting stage may be configured to provide a second gain that is two or more orders of magnitude higher than the first gain.

In some embodiments, the analog stage may include a first plurality of dynodes, and the pulse counting stage may include at least one avalanche diode.

In some embodiments, the first threshold may be based on an accuracy of the pulse counting signal and may be independent of an accuracy of the analog signal.

Other devices, apparatus, and/or methods according to some embodiments will become apparent to one with skill in the art upon review of the following drawings and detailed description. It is intended that all such additional embodiments, in addition to any and all combinations of the above embodiments, be included within this description, be within the scope of the invention, and be protected by the accompanying claims.

DETAILED DESCRIPTION

A mass spectrometry (MS) system includes an ion detector that generates a time-dependent electric output signal (e.g., a time-dependent voltage signal or a time dependent current signal) corresponding to the arrival of sample ions. To analyze samples using mass spectrometry, the intensity of the ion flux is measured (e.g., the number of ions that are detected by the ion detector per second).

Some conventional ion detectors and/or control circuits may be configured to monitor the analog signal level, and beyond a certain signal level (referred to herein as the crossover point), may switch output from the higher gain pulse counting output mode to the lower gain analog output mode, such the analog signal is used to indicate the concentration of the sample being measured. As any inaccuracy of the matching of the digital and analog detector signals may lead to discontinuities (also referred to as differential drift) in the output to the end-user, which may invalidate the results of the analysis. Cross-calibration operations are frequently performed to ensure that the conversion of the analog output signal (e.g., in micro- or nano- or pico-amperes) to the equivalent pulses per second is consistent with the pulse-counting output signal.

Embodiments of the present disclosure may arise from recognition that cross-calibration can reduce ease with which end-users operate mass spectrometry devices. For example, cross-calibration operations are typically time consuming, which may be inefficient to end-user workflow. Moreover, the crossover point may often occur at signal levels (based on typical sample concentration) that are frequently encountered by the end-users. Frequent cross-calibration operations may thus be costly and/or otherwise inconvenient, resulting in inefficiency, and in some instances can lead to instrument contamination.

Embodiments of the present disclosure may further arise from recognition that long-lifetime detectors can be operated in pulse counting output mode at gain levels higher than used conventionally. In particular, by varying one or more parameters of the ion detector, the threshold for switching from the pulse counting output mode to the analog output mode can be increased to a higher pulse counting range or capability, thereby shifting the crossover point beyond the range of pulse counts that are typically encountered by end-users. For example, the pulse-to-analog crossover point may be shifted to much higher signal levels (e.g., up to 50 times or more) in comparison to some conventional detectors.

Accordingly, some embodiments are directed to a mass spectrometry device where the crossover point is controlled to be in the range of about 10 million counts per second to about 200 million counts per second. This range of crossover point may not be possible using some conventional detectors because such conventional detectors may have insufficient lifetime to be used at such high count rates for any reasonable amount of time.

Figure 1:
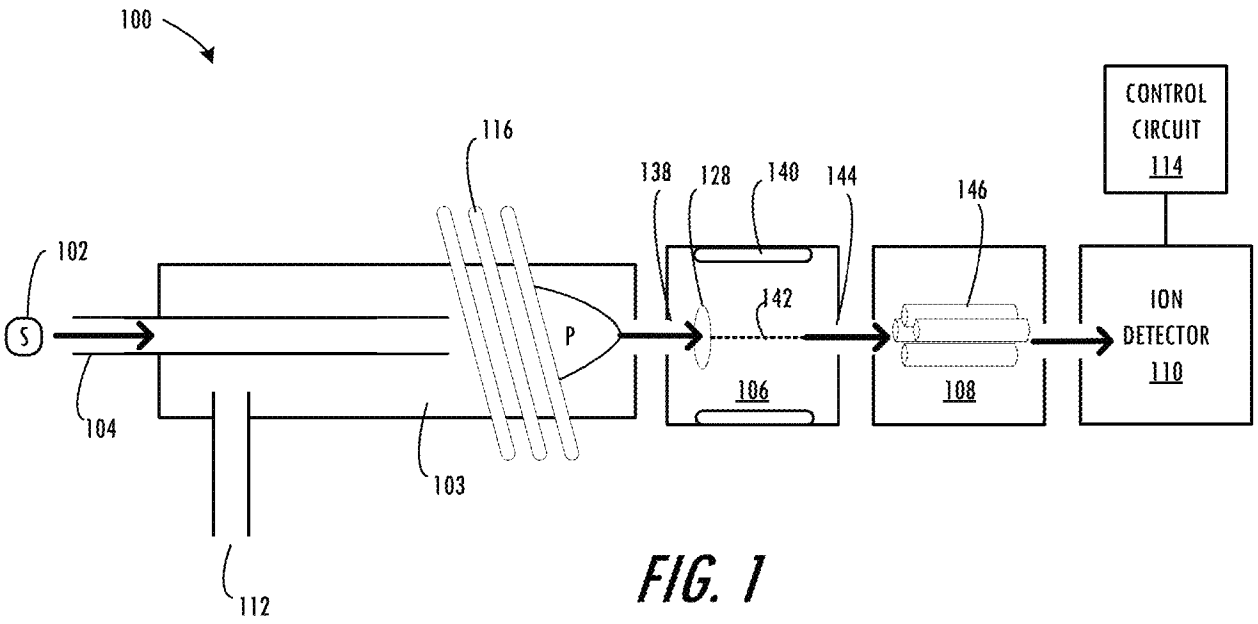
FIG. 1 is a schematic diagram illustrating example components of a mass spectrometry system according to some embodiments of the present disclosure.

FIG. 1 is a schematic diagram illustrating example components of a mass spectrometry system 100 according to some embodiments. The system 100 includes an ion source 102, an ion transfer chamber 106, a quadrupole mass filter 108, an ion detector 110, and a control circuit 114. Some embodiments are illustrated by way of example with reference to an inductively coupled plasma (ICP) mass spectrometer system 100; however, it will be understood that embodiments described herein are not limited to ICP-MS systems, and may be used in other mass spectrometry systems and/or other ion detection applications.

During operation of the system 100, the ion source 102 supplies a sample S contained in a liquid (e.g., water) or carrier gas (e.g., argon) through an injector tube 104 and into an intermediate tube 103 including an auxiliary gas (e.g., argon). Outer tube 112 provides flow of the main plasma gas (e.g., argon), which in combination with the injector tube 104 and intermediate tube 103 define the ICP torch. Plasma P may be generated by an induction coil 116 encircling the tube 103. The plasma P atomizes the sample stream S and ionizes the atoms, creating a mixture of ions and free electrons. The sample ions are extracted through aperture 138 (which may include one or more skimmer cones), and are transferred by an ion transfer chamber 106 to the entrance of the quadrupole mass filter 108. The transmission efficiency and resolving power of the quadrupole mass filter 108 may depend on the characteristics of the beam of sample ions entering the quadrupole mass filter 108 (e.g., the radial positions, angles, and to a lesser extent, kinetic energies, of the sample ions as they enter the quadrupole mass filter 108).

To improve these characteristics, the ion transfer chamber 106 includes ion optics 128 for focusing the ion beam. In some embodiments, the ion transfer chamber 106 can include an ion guide 140 that generates a radio frequency (RF) field in the ion transfer chamber 106. In some embodiments, the ion transfer chamber 106 can also generate an axial electric field (i.e., an electric field extending along the direction of the path of travel of the sample ion beam). Sample ions extracted through the aperture 138 are passed into the ion transfer chamber 106, and are constrained by the RF field to oscillate about an ion guide axis 142 as they traverse the length of the ion guide 140.

The focused ion beam at the exit end 144 of the ion transfer chamber 106 is injected into the entrance of a quadrupole mass filter 108 for mass analysis of the sample ions. The quadrupole mass filter mass may resolve the sample ions (e.g., based on their mass-to-charge ratios (m/z)). As an example, the quadrupole mass filter 108 can include four parallel electrically conductive rods 146 arranged in a 2×2 configuration, where each pair of opposing rods is electrically connected. A RF voltage with a DC offset voltage is applied between one pair of rods 146 and the other. As sample ions travel down the quadrupole between the rods, only ions of a certain mass-to-charge ratio will reach the detector 110 for a given ratio of voltages. Other ions have unstable trajectories and will collide with the rods. This permits selection of an ion with a particular m/z.

The mass-resolved ions exit through an exit end of the quadrupole mass filter 108, and are directed to the ion detector 110. The ion detector 110 outputs a signal indicating a charge induced or the current produced by the arrival of ions at the ion detector 110, as described in greater detail with reference to FIG. 2. The output signal may be transmitted to a discriminator module or circuit (not shown) for further processing (e.g., to distinguish between changes in the output signal corresponding to the arrival of a particular ion (e.g., having a particular m/z) and changes in the output signal resulting from other factors (e.g., signal noise)) in some embodiments.

The control circuit 114 is communicatively coupled to and controls the operation of the system 100. For example, in some embodiments, the control circuit 114 can provide instructions or commands to regulate the performance of some or all of the components of the system 100. In some embodiments, the control circuit 114 can record data output by ion detector 108 regarding the ions, such as the number of ions arriving at the ion detector 110 and the m/z of each of those ions. For example, the control circuit 114 may include counting circuits that count the number of (e.g., square wave) pulses indicated by one or more output signals from the ion detector 110. In some embodiments, the control circuit 114 can be implemented using one or more computing devices (e.g., one or more electronic processing devices, each having one or more microprocessors), digital circuitry, analog circuitry, software, or a combination thereof.

Figure 2:
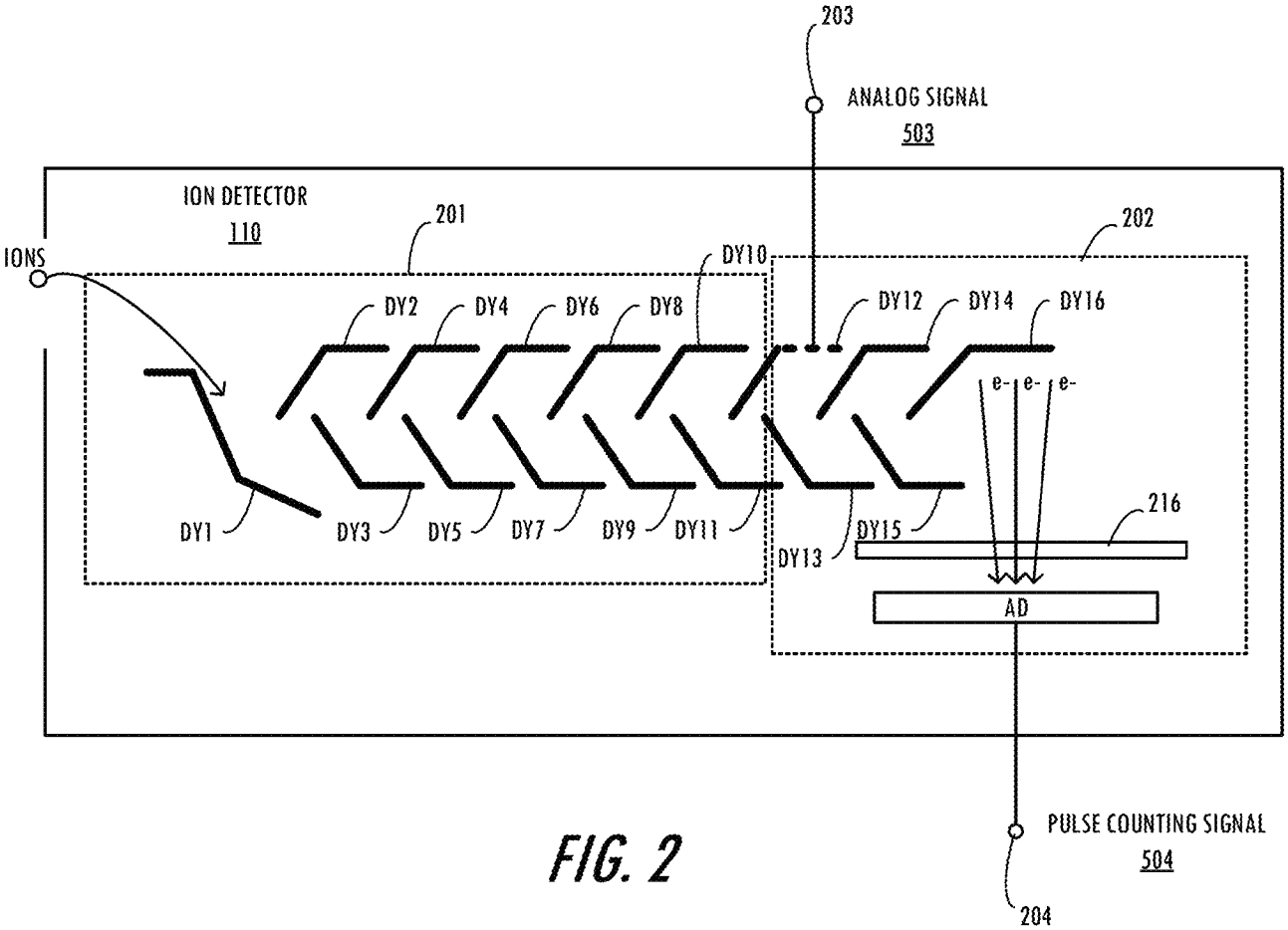
FIG. 2 is a schematic diagram illustrating example components of an ion detector according to some embodiments of the present disclosure.

FIG. 2 is a schematic diagram illustrating example components of the ion detector 110 according to some embodiments. As shown in FIG. 2, the example ion detector 110 includes a first, analog stage 201 that is configured to receive incident ions (e.g., as output from the quadrupole mass filter 108), perform initial conversion of the ions into electrons (e−), and output an analog signal 503 having an initial charge amplification or gain from an analog port 203; and a second, pulse counting stage 202 that is configured to receive electrons from the first stage 201, perform further charge amplification or gain (e.g., two or more orders of magnitude higher than the initial gain of the first stage 201), and output a pulse counting signal 504 indicating ion pulses with sufficient amplitude to be counted by counting circuits from counting port 204.

In the example of FIG. 2, the analog stage 201 includes a first plurality or set of dynodes DY1-DY11, and the pulse counting stage 202 includes a second plurality or set of dynodes DY12-DY16, a focus electrode 216, and a detector (illustrated by way of example as an avalanche diode AD). The ions (e.g., produced from the sample S being analyzed) enter the analog stage 201 of the detector 110 and are strongly attracted to (i.e. accelerated towards) the first dynode DY1, which is configured (e.g., using a surface treatment) to convert the incoming or incident ions to electrons. Each sequential dynode DY2-DY11 in the chain or sequence may have a higher voltage (e.g., a more positive voltage) than the one preceding it, and may be configured to eject multiple electrons for each incoming electron, such that the chain or sequence of dynodes DY1-DY11 in the analog stage 201 produces a "cascade" of electrons, where the number of electrons increases (by perhaps 2 or 3-fold) at each dynode to provide the electronic amplification or gain of the incoming charge in the analog stage 201.

After amplification, a portion of the electron pulse is output (as shown, at dynode DY12) via analog port 203 as an analog signal 503, which may be further amplified (e.g., by the control circuit and/or other circuitry in accordance with embodiments described herein) and used in an analog output mode to quantify the number of ions from the sample and/or to control the behavior of the overall detection system 110. The analog signal 503 (which may be measured in units of electric current; typically micro- or nano- or pico-amperes) may be of relatively low amplitude, and thus may be used for measurement when the number of incoming ions is relatively large (i.e., from highly concentrated chemical samples).

Still referring to FIG. 2, the initial dynode DY12 of the second, pulse counting stage 202 may be configured (e.g., based on perforations therein) to allow a portion (e.g., about 50%) of the electron pulse to continue for further amplification by dynodes DY13-DY16, and is provided to the solid state detector AD via focus electrode 216. The detector AD may be configured to provide a high electronic gain, and performs further amplification of the electron pulse, to a level where it may be processed by counting circuitry. The signal at the detector AD is output via the counting port 204 as the pulse counting signal 504, and is used in a pulse counting output mode to quantify the number of ions from the sample and/or to control the behavior of the overall detection system 110. The pulse counting signal 504 (which may be measured in units of pulses per second, counts per second, ions per second, cycles per second or frequency) may thus have significantly greater amplification (e.g., by an order of magnitude of about 2 or more) as compared to the analog signal 503, and thus may be used for measurement when the number of incoming ions is relatively small (e.g., from lower concentration or dilute chemical samples).

Both the analog signal 503 and the pulse counting signal 504 may be monitored (e.g., by the control circuit 114, which may include electronics, embedded software/firmware, and/or end-user software), as described in greater detail below with reference to FIG. 3. Due to pulse overlapping effects, the pulse counting signal 504 may become inaccurate above a certain count rate (also referred to herein as signal level), while the analog signal 503 may have a substantially linear response up to very high signal levels. Moreover, detector lifetime may be based on the electron multiplication provided by the dynodes, where higher multiplication rates may result in increased dynode wear and reduced detector lifetime.

Some conventional ion detectors and/or control circuits may thus be configured to monitor the analog signal level (e.g., at the analog port 203), and beyond a certain signal level (referred to herein as the crossover point), may switch output from the higher gain pulse counting output mode to the lower gain analog output mode, such the analog signal is used to indicate the concentration of the sample being measured. The switching from the digital to the analog mode effectively removes or otherwise reduces a gain of a subset of the dynodes (e.g., dynodes DY12 to DY16 of the pulse counting stage 202) from the output of the ion detector, thereby extending the life of these dynodes. For example, in a typical dual-mode detector, the bias potential to the pulse counting stage 202 of the detector 110 is turned off, such that the gain is only defined by the bias potential to the first dynode versus ground (analog port 203). This switch may occur, for example, when the effective pulse count indicated by the analog signal is about 2 million counts per second.

The correlation between analog and pulse counting signals may be determined (e.g., by the control circuit 114 and/or by end-user software) based on the analog and pulse counting signals over a wide range of signal levels. For example, a lookup table or plot may be used to determine the correlation (coefficient or relationship) that allows the analog signal (measured in units of electrical current) to be converted to units of pulses per second (as reported by the pulse counting electronics).

Some embodiments of the present disclosure may arise from realization that, particularly for longer-lifetime ion detectors, the gain and/or dynamic range of the ion detectors can be increased. In particular, by varying one or more parameters of the ion detector, the threshold for switching from the pulse counting output mode to the analog output mode can be increased to a higher pulse counting range or capability, thereby shifting the crossover point beyond the range of pulse counts that are typically encountered by end-users. Such parameters may include, but are not limited to, reducing the pulse width of the pulse counting signal; increasing the output current without substantial pulse amplitude degradation; and increasing the total output charge capability (e.g., the total number of electrons that can be output over the lifetime of the device, measured in Coulombs; also referred to as charge transfer capability).

Embodiments of the present disclosure may thus achieve a wide dynamic range ion detection system with good lifetime and little to no differential drift error over an extended count capability range. Ion detectors and associated control circuitry as described herein may thus provide balanced performance between adequate detector lifetime and accurate, trouble-free, wide dynamic range capability, with improvement of both such performance aspects relative to some conventional ion detectors. In particular, the pulse-to-analog crossover point may be shifted to much higher signal levels (e.g., up to 50 times or more) in comparison to some conventional ICP-MS instruments using dual mode ion detectors, such that any inaccuracies introduced by the crossover may occur in a sample concentrations beyond that typically encountered by end-users.

Figure 3:
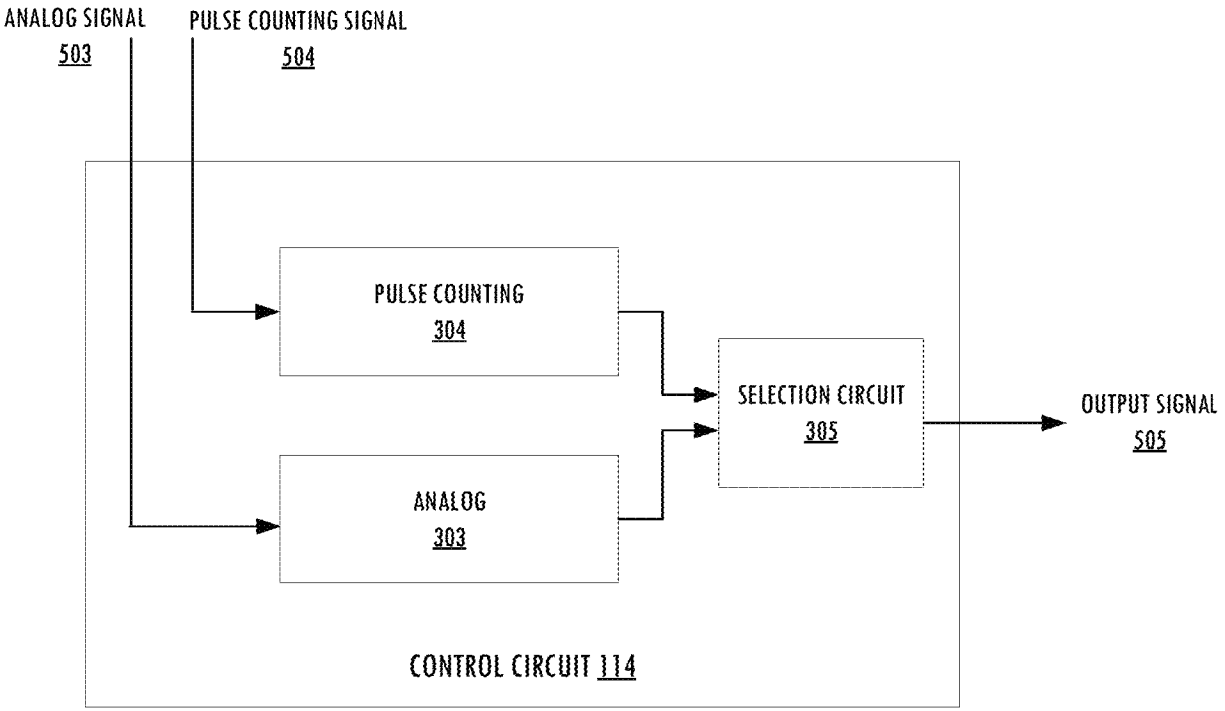
FIG. 3 is a schematic diagram illustrating an example control circuit according to some embodiments of the present disclosure.
Figure 4A:
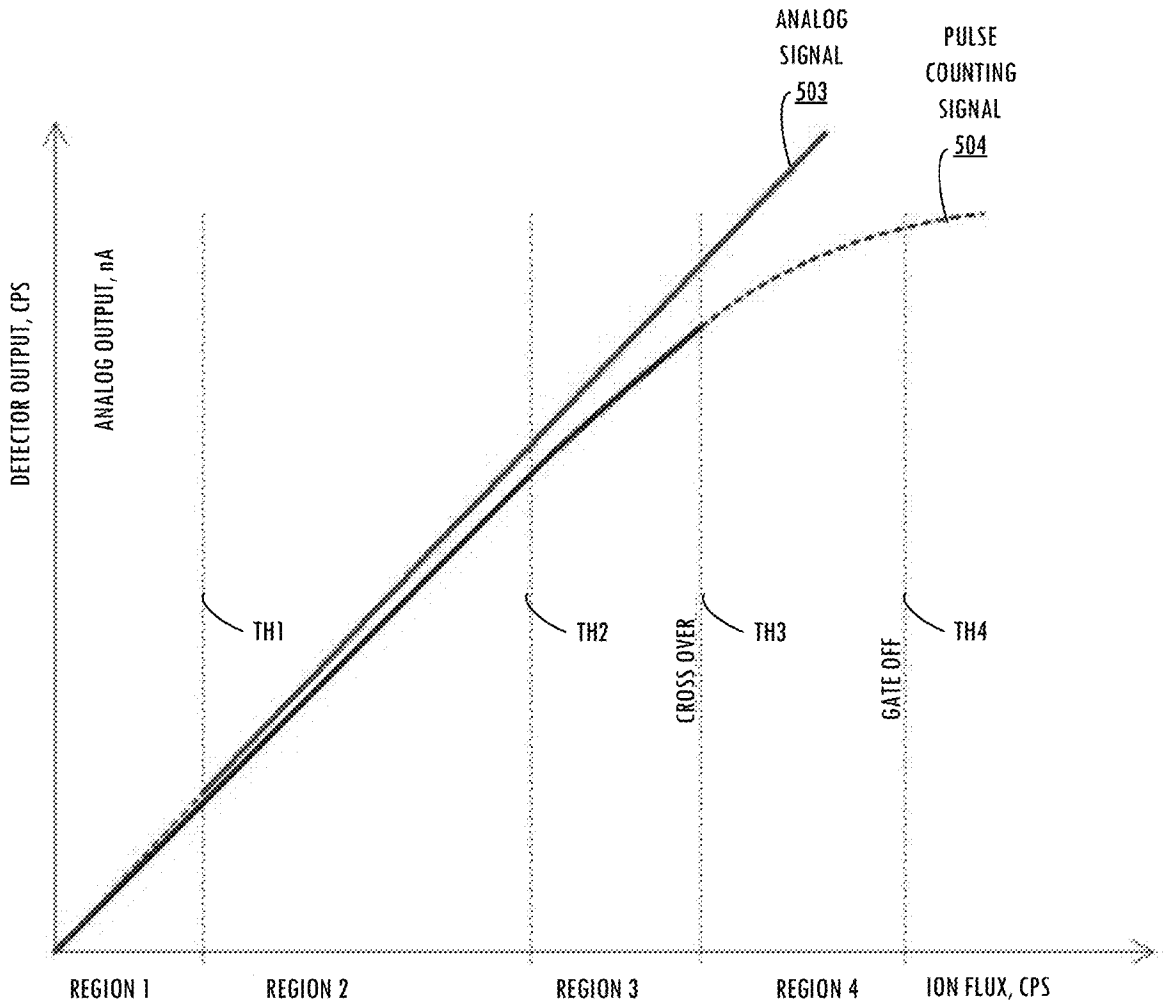
FIG. 4A is a graph illustrating example thresholds for switching between pulse counting and analog output modes according to some embodiments of the present disclosure in comparison with conventional ion detectors.
Figure 5B:
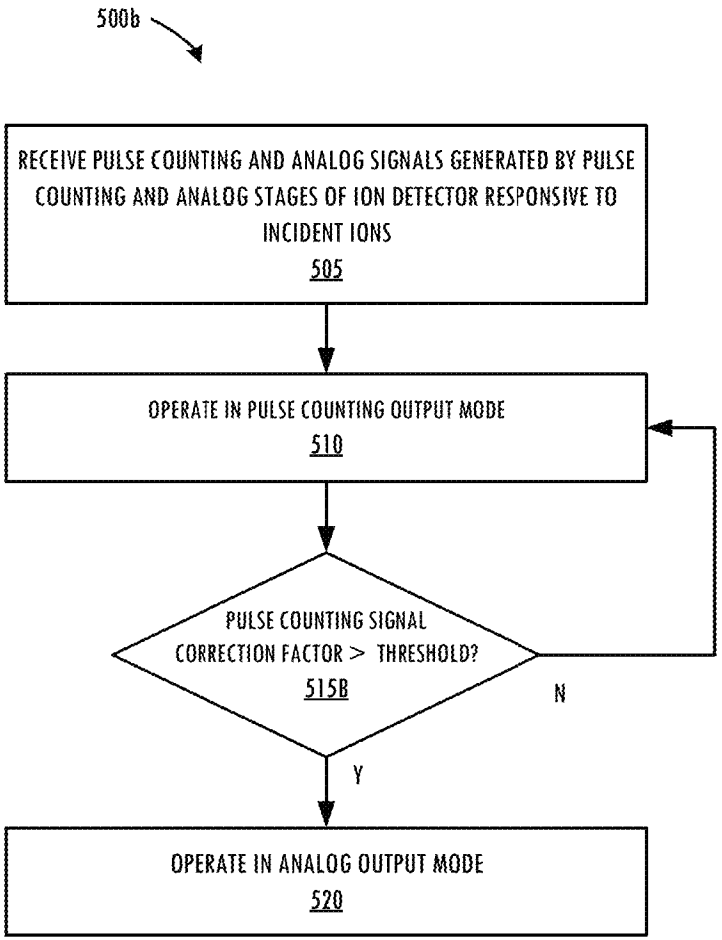
FIGS. 5A and 5B are flowcharts illustrating operations for switching between pulse counting and analog output modes according to some embodiments of the present disclosure.
Figure 5A:
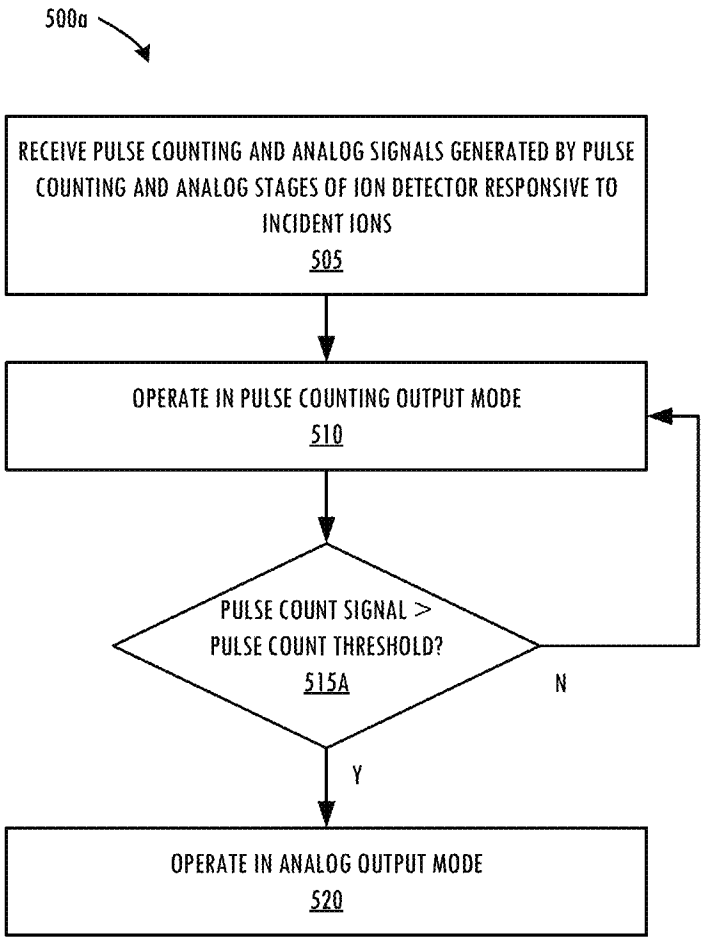

FIG. 3 is a schematic diagram illustrating an example control circuit 114 according to some embodiments. FIG. 4A is a graph illustrating example thresholds for switching between pulse counting and analog output modes according to some embodiments, which may be used by the control circuit 114 of FIG. 3, in comparison with some conventional ion detectors. FIGS. 5A and 5B are flowcharts illustrating operations for switching between pulse counting and analog output modes according to some embodiments, which may be performed by the control circuit 114 of FIG. 3 in some embodiments.

As shown in FIG. 3, and FIGS. 5A-5B, the control circuit 114 is configured to receive outputs from an ion detector, for example, the ion detector 110. In particular, the control circuit 114 is configured to receive pulse counting signals 504 and analog signals 503 responsive to operation of the ion detector (block 505). The pulse counting signals 504 and analog signals 503 may be generated as described above with reference to FIG. 2.

The control circuit 114 may represent one or more controllers, processors, etc. that are configured to carry out the operations described herein. The control circuit 114 can be implemented by any combination of digital circuitry, analog circuitry, and software, and is configured to operate in one of multiple output modes depending on characteristics of the outputs received from the ion detector. In the example of FIG. 3, the control circuit 114 includes pulse counting mode circuitry 304 for operation in a pulse counting output mode (block 510) to output the pulse counting signal 504 as the output signal 505, and analog mode circuitry 303 for operation in an analog output mode (block 520) to output the analog signal 503 as the output signal 505. The pulse counting mode circuitry 304 may be coupled to the counting port 204 of the ion detector 110, while the analog mode circuitry 303 may be coupled to the analog port 203 of the ion detector. The control circuit 114 further includes a selection or switching circuit 305 that is configured to switch operation of the control circuit 114 from the pulse counting mode output/circuitry 304 to the analog mode output/circuitry 303 responsive to a threshold (blocks 515A, 515B).

The threshold for operation of the selection circuit 305 to switch or otherwise transition from the pulse counting mode output/circuitry 304 to the analog mode output/circuitry 303 may be based on the pulse counting signal. In FIG. 5A, the threshold (at block 515A) is based on a number of pulse counts indicated by the pulse counting signal. In FIG. 5B, the threshold (at block 515B) is based on an accuracy of the pulse counting signal. For example, the control circuit 114 may be configured to correct an accuracy of the pulse counting signal based on a correction factor, and the selection circuit 305 may be configured to switch from the pulse counting mode output/circuitry 304 to the analog mode output/circuitry 303 based on the correction factor relative to a threshold value. In some embodiments, the pulse count threshold (at block 515A) may be determined with respect to the corrected pulse counting signal, i.e., based on the correction factor.

In some embodiments, the control circuit 114 is configured to switch from the pulse counting mode output/circuitry 304 to the analog mode output/circuitry 303 (at block 515A) responsive to the pulse counting signal exceeding a pulse count threshold within a range of about 10 million counts per second (i.e., 10 MHz) to about 200 million counts per second (i.e., 200 MHz), for example, within a range of about 30 million counts per second (i.e., 30 MHz) to about 150 million counts per second (i.e., 150 MHz), or within a range of about 60 million counts per second (i.e., 60 MHz) to about 100 million counts per second (i.e., 100 MHz).

In some embodiments, the control circuit 114 may be configured to switch from the pulse counting mode output/circuitry 304 to the analog mode output/circuitry 303 (at block 515B) responsive to the correction factor exceeding a threshold correction factor of about 1.5 or more. The correction factor may be used to multiply the pulse count signal output from the counting port 204 to correct for inaccuracy in detection and thereby provide a corrected pulse count signal. For example, in avalanche photodiode-based ion detectors, carriers (electrons and holes) excited by photons that are absorbed at the diode AD may be accelerated to generate secondary carriers in an avalanche process, thereby amplifying the photocurrent. In response, an electronic quenching circuit can be used to reduce the voltage at the diode AD below the threshold voltage for a short time so that the avalanche is stopped and the diode AD is ready for detection of further photons after some recovery time (also referred to as "dead time").

Figure 4B:
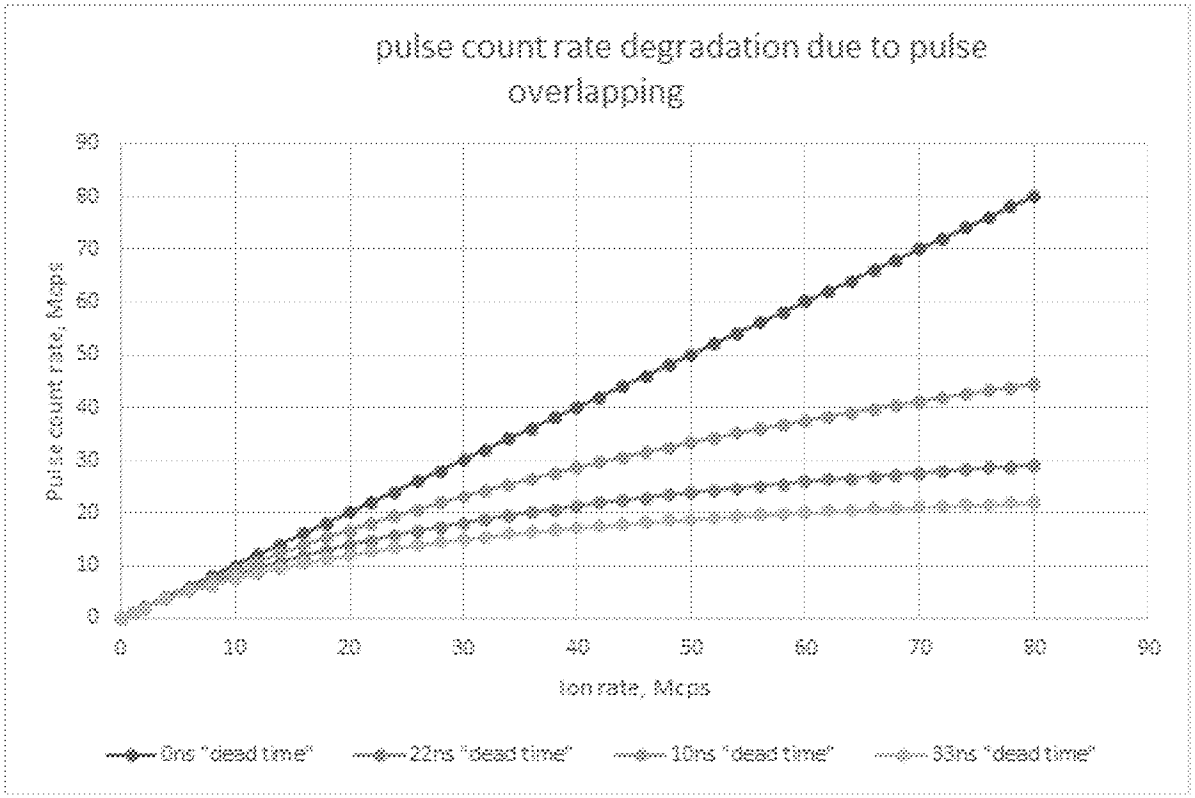
FIG. 4B is a graph illustrating effects of dead time on pulse count rate, which may be corrected by correction factors according to some embodiments of the present disclosure.

The correction factor may thus be a dead time correction factor, which is used by the control circuit 114 to multiply or otherwise correct the photon count indicated by the pulse counting signal for the dead time of the avalanche diode AD. FIG. 4B illustrates the effects of dead time on pulse count rate (vs. actual ion rate). As illustrated in FIG. 4B, the correction factor may be a function of system dead time (i.e., dependent on the pulse width of the pulse counting output) and pulse rate. The correction factor K may be defined as $K=1/(1-dt*Np)$, where dt is an average dead time and Np is pulse count rate per second. Lower pulse rates may require a smaller correction factor. For example, if the dead time is about 10 ns, the pulse counting will be lower than the actual ion rate by about 2% at 2 Mcps (i.e., requiring a correction factor of about 1.02). At 10 Mcps, the required correction factor may be about 1.1. In some embodiments, the threshold correction factor (at block 515B) may be greater than about 1.5, for example, greater than about 2.0, which may be sufficient to correct for a dead time of about 35 nanoseconds or more. In some embodiments, the threshold correction factor may be about 2.8, and the control circuit 114 may be configured to switch from the pulse counting mode output/circuitry 304 to the analog mode output/circuitry 303 (at block 515B) when the corrected pulse count signal is about 100 million cps or more (i.e., corresponding to an actual pulse count of about 35 million cps).

In some embodiments, the increased digital count rate capability provided by shifting the pulse counting to analog crossover point in accordance with embodiments of the present disclosure may allow for increased dynamic range. For example, to increase the pulse count threshold (at block 515A) by a factor of 10, the electronic gain of a pre-amplifier used with the analog stage 201 may be reduced by a factor of 10, and the dynamic range of the ion detector 110 may be increased proportionally. That is, the electronic gain of the analog-stage preamplifier may be reduced by a factor similar to that by which the pulse counting stage 202 to analog stage 201 crossover point is increased. In some embodiments, the increased digital count rate capability alone may be sufficient to meet customer requirements, and thus the analog operation may be omitted. The transitioning from the pulse counting mode output/circuitry 304 to the analog mode output/circuitry 303 based on the pulse counting signal-based thresholds described herein may thus be critical to achieving performance benefits described herein.

The operations and/or thresholds for transitioning from the pulse counting mode output/circuitry 304 to the analog mode output/circuitry 303 (at blocks 515A and 515B) may be primarily based on the magnitude (e.g., the pulse count rate) and/or accuracy (e.g., the correction factor) of the pulse counting signal 504, rather than based on (and in some embodiments, independent of) the magnitude and/or accuracy of the analog signal 503. In contrast, some conventional ion detectors may be reliant on crossover thresholds that are based on the analog signal, e.g., configured to switch from pulse counting output to analog output when the analog signal is sufficiently accurate (i.e., as accurate as or more accurate than the pulse counting signal), which can preserve lifetime of the ion detector by disabling the dynodes of the higher-gain pulse counting stage.

Some embodiments of the present disclosure may operate as described herein without substantially sacrificing lifetime of the dynodes DY1-DY16 by configuring the ion detector 110 to provide a higher charge transfer capability (e.g., greater than about 1 Coulomb, for example about 10 Coulombs or more) in comparison to some conventional ion detectors. For example, the ion detector 110 may have an charge transfer capability of greater than about 30 Coulombs, or greater than about 100 Coulombs. The higher charge transfer capability may be achieved by configuring the pulse counting stage 202 to be capable of reliably performing a majority of the high-current amplification, for example, by using one or more solid state detector devices (e.g., avalanche diodes AD) instead of additional dynodes. Such solid state detectors AD may provide a charge transfer capability of more than about 100 times (and thus may have an inherently longer lifetime) in comparison to some conventional detection devices, which may be based on "active surfaces" of dynodes, and which may suffer from surface degradation effects after exposure to relatively small amounts of charge. That is, some conventional ion detectors may not be feasibly operated as described herein, as such conventional detectors may have insufficient total output charge capability and thus may degrade rapidly if used at high output count rates. The charge transfer capability of the ion detector 110 within the ranges described herein may thus be critical to achieving the performance benefits described herein.

In some embodiments, the ion detector 110 and/or the control circuit 114 may be configured to generate the pulse counting signal 504 (e.g., as output at the counting port 204) with a pulse width that is sufficiently narrow to allow for crossover at the higher pulse counting rates described herein. In particular, the pulse widths of the pulse counting signal 504 may be a limiting factor in the accuracy of the pulse counting signal at higher count rates. As such, the ion detector 110 and/or the control circuit 114 may be configured to generate the pulse counting signal 504 having a pulse width of less than about 5 nanoseconds as measured at a "tail" portion (e.g., about 10% or less of the pulse amplitude) of the pulse. For example, in contrast to some conventional ion detectors that may use a larger number of dynodes in the pulse counting stage to achieve higher gain (at the expense of broadening of the output signal pulse width), some embodiments of the present disclosure may utilize one or more avalanche diodes AD to replace multiple dynodes of the pulse counting stage, to provide a similar or greater gain but with narrower output signal pulse widths. In the example of FIG. 2, the pulse counting stage 202 includes fewer dynodes DY12-DY16 (in comparison to the number of dynodes DY1-DY11 of the analog stage 201) in combination with at least one avalanche diode AD. In some embodiments, the pulse counting stage 202 and/or the control circuit 114 may be configured to generate the pulse counting signal with a pulse width of less than about 5 nanoseconds, less than about 4 nanoseconds, or less than about 3 nanoseconds, as measured at about half of the pulse amplitude. The pulse counting stage 202 and/or the control circuit 114 may be configured to control the pulse counting signal to have the pulse width of 5 ns or less and a pulse rate of up to about $1\times10^8$ pulses per second/100 MHz or more.

Further aspects of the ion detector 110 and/or control circuit 114 that may be configured to generate the pulse counting signal with narrower pulse widths may include, but are not limited to, matching of the output impedance of the ion detector 110 to the input impedance of the pulse counting circuitry 304; use of particular types of avalanche diodes AD or other detectors; selection of the voltage applied to avalanche diode AD; selection of high speed preamplifier components; improvement or optimization of decoupling of pulse counting output from high voltage DC bias; use of a band pass (rather than a wide bandwidth) high speed amplifier; use of a higher speed pulse discrimination with threshold optimization including base line correction at high pulse rate; and statistically averaging dead time over pulse count interval (integration time) rather than hardware-based pulse-width equalization for correction of pulse count due to dead time. Configuring the ion detector 110 and/or the control circuits 114 to provide the pulse width within ranges described herein may thus be critical to increasing the crossover threshold to achieve the performance benefits described herein.

In some embodiments, the ion detector 110 and/or the control circuit 114 may be configured to provide the output current level of the pulse counting signal to be greater than about 30 microamperes. For example, the ion detector 110 and/or the control circuit 114 may be configured to provide an output current of greater than about 100 microamperes, or greater than about 180 microamperes. In some embodiments, the high voltage power supply (HVPS) used to drive the ion detector 110 may be capable of supplying the higher current, without degradation in the quality of the high voltage current supplied (i.e., without increased "noise" or instability in the high voltage). Additionally or alternatively, the ion detector 110 itself may have a relatively low electrical resistance, and/or may be configured to dissipate heat in vacuum, such that the ion detector 110 can accept increased current input and output. This can be achieved by selection of one or more components (e.g., resistors) within the detector assembly, and/or configurations for heat transfer from high voltage components. Also, the detector AD may be capable of outputting high current, without suffering degradation (i.e., heating effects, high noise, at high output currents). In some embodiments, the ion detector 110 may be configured to provide higher output currents at higher frequencies or pulse count rates, with degradation in gain of the pulse counting stage 202 by less than a factor of 4.

As noted above, FIG. 4A is a graph illustrating example operations and thresholds for switching between the pulse counting mode output/circuitry 304 and the analog mode output/circuitry 303 (at blocks 515A and/or 515B) according to some embodiments, in comparison with some conventional ion detectors. In particular, the example of FIG. 4A illustrates four pulse count thresholds (TH1, TH2, TH3, and TH4; in counts per second, cps), defining four regions (Region 1, Region 2, Region 3, Region 4) of ion detector operation. The analog signal 503 (e.g., at the analog port 203) is illustrated in nano-amperes (nA), while the pulse counting signal 504 (e.g., at the counting port 204 or output of the detector AD) is illustrated in cps.

In Region 1, the analog signal may be considered invalid (e.g., due to electronic noise etc.; as shown by the dashed line), while the pulse counting signal may be considered as valid or more accurate. In Region 2, the analog signal is considered valid, but less accurate than the pulse counting is accurate. In Region 3, the analog signal is considered valid, and may be more accurate than the pulse counting signal (e.g., due to lost ion counts due to overlapping pulses). Operation in Region 3 may involve noticeable aging or degradation of the dynodes in the pulse counting stage. In Region 4, the analog signal is accurate, while the pulse counting may be considered invalid (e.g., due to too many lost ion counts). Operation in Region 4 may involve more severe aging and/or potential damage to the dynodes in the pulse counting stage.

Some conventional ion detectors may monitor both the analog signal 503 and the pulse counting signal 504, and may perform the "crossover" from the output of the pulse counting signal 504 to the output of the analog signal 503 (converted to its pulse counting equivalent) at the threshold TH2, e.g., at about 2 million cps, when the analog signal 503 is sufficiently accurate/more accurate than the pulse counting signal 504. In some conventional ion detectors, this crossover may be software-based, such that the dynodes of the pulse counting stage continues to generate the pulse counting signal 504 even after the analog signal is sufficiently accurate. However, when the analog signal 503 reaches a greater threshold, (e.g., about 5 million counts/second) the pulse counting stage may be deactivated (e.g., by setting the gate to low voltage, e.g., zero or "gate-off"), to prevent the detector from further processing ions. This physical deactivation of the pulse counting stage (also referred to as pulse section protection) may occur at a higher threshold than the software-based crossover, in order to reduce the likelihood of discontinuities around the crossover point TH2 (e.g., as the disabling of the pulse counting stage can cause instability in the output, and also to avoid disabling of the pulse counting stage before the crossover to the analog signal 503 is completed). That is, some conventional ion detectors may perform crossover and/or pulse section protection based on the magnitude and/or accuracy of the analog signal 503.

In contrast, in some embodiments of the present disclosure, the ion detector 110 and/or the control circuit(s) 114 are configured to perform the crossover from the output of the pulse counting signal 504 to the output of the analog signal 503 primarily based on the magnitude (e.g., cps) and/or accuracy (e.g., correction factor) of the pulse counting signal 504, even after the analog signal 503 is sufficiently accurate to deactivate the pulse counting stage 202 and preserve the lifetime of the ion detector 110. As shown in FIG. 4A, the ion detector 110 and/or the control circuit(s) 114 are configured to perform the crossover from the output of the pulse counting signal 504 to the output of the analog signal 503 at a higher threshold TH3, e.g., between about 10 million cps and about 200 million cps, for example, at a threshold TH3 of about 30 million cps to about 150 million cps, or even at about 50 million to about 100 million cps. The crossover threshold TH3 may thus be based on the pulse count rate of the pulse counting signal 504.

Additionally or alternatively, the crossover threshold TH3 may be based on the accuracy of the pulse counting signal 504 (e.g., based on output pulse widths within a range that can be accurately corrected by a correction factor). A pulse counting signal having wider pulse widths (or pulses with higher amplitude tail sections) may be problematic due to overlap between consecutive pulses at higher pulse count rates, and may thus require correction in order to provide an accurate pulse count. As such, the "raw" pulse counting signal (e.g., as provided at the counting port 204/output of the detector AD) may be multiplied by the correction factor to provide a "corrected" pulse counting signal for output by the ion detector 110. Some embodiments described herein may thus continue to operate in the pulse counting mode (e.g., for pulse count rates that fall within Region 3 of the graph of FIG. 4A, despite the sufficient or even greater accuracy of the analog signal 503 and/or the possible degradation of the dynodes in the pulse counting stage) by correcting the pulse counting signal 504 as described herein until the correction factor exceeds a value corresponding to the crossover threshold TH3. That is, the control circuit 114 may be configured to switch the from the pulse counting output mode 304 to the analog output mode 303 when the correction factor exceeds a threshold value beyond which accurate correction of the pulse counting signal 504 may not be possible (e.g., where the pulses of the pulse count signal 504 are overlapping too frequently to be corrected).

In some embodiments, the correction factor threshold value may be greater than about 1.5 or more, e.g., about 2.0 or more or 2.5 or more, but less than about 3.0 or 3.5. For example, for an avalanche-diode based detector AD in a pulse counting stage 202 configured as described herein, the correction factor may be about 2.8, such that the cross over threshold TH3 may be about 100 million cps when correcting a raw pulse counting signal of about 35.7 million cps. It will be understood that, while described with reference to the pulse width as a limiting factor for the accuracy of the pulse counting signal 504 at higher pulse count rates, other or associated limiting factors may include a reduction in pulse amplitude (e.g., due to limitations of the detector), and/or the effective level of pulse discrimination due to AC coupling (e.g., due to limitations of the front-end electronics).

Accordingly, in embodiments of the present disclosure, the crossover threshold TH3 may be based on the pulse count rate and/or correction factor of the pulse counting signal 504, rather than the lower threshold TH2 where the analog signal 503 may be sufficiently and/or more accurate than the pulse counting signal 504. From a performance perspective, once the crossover threshold TH3 is exceeded, the pulse counting signal 504 may become increasingly inaccurate (shown by the dashed lines in FIG. 4A) due to increasing number of lost ions entering the detector at too short time intervals.

In some embodiments, the operations for switching to the analog output mode 303 based on the crossover threshold TH3 may be controlled by the control circuit 114 and/or associated computer program code rather than in the ion detector 110 itself, such that the dynodes of the pulse counting stage 202 may continue to generate the pulse counting signal 504 even after the crossover threshold TH3 at which the analog signal 503 is output as the preferred signal. However, as the pulse counting stage 202 may have inherent electrical current limitations (e.g., based on the capability of the high-voltage power supply and/or internal resistors), the output of the pulse counting stage 202 may be reduced and/or deactivated responsive to the pulse counting signal 504 exceeding a threshold TH4, i.e., a pulse section protection threshold. The threshold TH4 is higher than the crossover threshold TH3 (e.g., to reduce or prevent signal discontinuities, as discussed above), but may be sufficient for operation without negatively affecting the lifetime of the detector AD beyond acceptable levels. In some embodiments, a physical switch may be used to deactivate the output of the pulse counting stage 202 (e.g., by applying a signal "gate off" to the gate terminal of a FET-based switch). In some embodiments, operation of one or more components of the pulse counting stage 202 may be reduced without completely deactivating the pulse counting stage 202, but in a manner that sufficiently reduces the gain of the pulse counting stage 202 to reduce or prevent damage. It will be understood that partially and/or completely deactivating the pulse counting stage 202 beyond the threshold TH4 is described by way of example, and that embodiments of the present disclosure are not limited to these operations.

In some embodiments, the control circuit 114 may also be configured to prevent cross-calibration of the pulse counting signal 504 and the analog signal 503 based on the pulse count rate and/or correction factor of the pulse counting signal 504. For example, in the graph of FIG. 4A, detector cross-calibration operations may be performed in Regions 2 and/or 3 (i.e., below the thresholds TH2 and/or TH3) to cross calibrate the respective slopes of the pulse counting signal 504 and the analog signal 503 to a similar value. In some embodiments, the control circuit 114 may be configured to prevent cross-calibration operations responsive to the pulse counting signal 504 indicating a pulse count rate of less than about $2\times10^5$ cps.

Further details in accordance with embodiments of the present disclosure are provided below. In particular, some embodiments of the present disclosure may provide a "digital mode optimized" ion detection system 110 for ICP-MS instruments, which may be configured to effectively eliminate differential drift and signal discontinuities between the digital/pulse counting stage 202 and the analog stage 201 of the detector, while still achieving wide dynamic range and good lifetime. While described primarily with reference to ICP-MS ion detection by way of example, it will be understood that embodiments of the present disclosure may be applied to any long-life ion detectors (of varying technology).

In particular, to reduce or minimize cross-calibration problems as noted above, some embodiments of the present disclosure may shift the cross over point from the digital output mode/circuitry 304 to the analog output mode/circuitry 303 to a substantially higher (e.g., about 5 times to about 100 times) threshold. For example, the control circuit 114 may be configured to switch from the digital output mode/circuitry 304 to the analog output mode/circuitry 303 responsive to the pulse counting signal exceeding about 10 million to 200 million cps (e.g., about 50 to 100 million cps), which may rarely be reached in practical customer usage. With such operation, the ion detection system 110 could be effectively considered as an "all-digital" system, with an additional "analog mode" extension of the dynamic range for the very highest signal levels.

Problems that may arise in shifting the digital to analog cross over point to a substantially higher pulse counting threshold may include, but are not limited to, pulse counting signal accuracy; degradation in detector lifetime (e.g., as dynodes of the ion detector may wear out more rapidly); and potential electrical issues (e.g., overheating of the ion detector). Some embodiments of the present disclosure may address these and other issues by configuring the ion detector 110 (including components of the pulse counting stage 202) and/or the control circuit(s) 114 (including signal processing electronics and/or software) as described herein. For example, in some embodiments, the ion detector 110 and/or the control circuit 114 may be configured to generate the pulse counting signal 504 with a narrow output pulse width. A narrow output pulse width results in reduced pulse overlap, which may require less dead time correction at high count rates. In some embodiments, the ion detector 110 and/or the control circuit 114 may be configured to output pulses at a desired rate and amplitude, while reducing or minimizing the decrease of peak amplitude with increasing pulse count rate (i.e., minimal gain depression). For example, the control circuit 114 in some embodiments may include detector drive circuitry (e.g., including a HVPS) that is configured to provide higher current output. In some embodiments, the detector AD may be configured to provide narrower pulse width, reduced "tailing", and higher output current capability, which, in combination with the improved high voltage and signal processing circuitry of the control circuit 114, can achieve accurate pulse counting rates to beyond 100 million cps (i.e., 100 MHz). Moreover, with the cross over threshold set to such a higher pulse count level, the cross over may often occur beyond or outside of the range of operation typically encountered in customer use, and thus (from an end user standpoint) the ion detection system 110 may not be affected by or may be essentially free of differential drift effects.

In some embodiments, despite the increase in the pulse counting/digital dynamic range provided by the higher the pulse counting threshold, the overall linearity of the ion detector 110 (including the signals 504 and 503 from the pulse counting stage 202 and the analog stage 201 combined) may be maintained, without substantial or unacceptable degradation in detector lifetime. That is, when configured to provide the pulse counting signal-based thresholds, charge transfer capability, and/or output pulse widths as described herein, embodiments of the present disclosure may achieve improvements in digital mode performance without substantially compromising other performance aspects. Although described herein with respect to a particular ion detector configurations (e.g., as shown in FIG. 2), embodiments of the present disclosure are not limited to any particular detector configuration, and can be applied to other dual mode or multi-mode ion detectors as well.

Accordingly, some embodiments described herein provide a multi-mode ion detector that is configured to extend the digital pulse counting range so as to shift the digital to analog signal cross over point well beyond the region where customers typically operate the instrument, for example, 40× to 50× higher than some conventional implementations, at some expense in detector lifetime. Any discontinuity or differential drift that may occur between the digital and analog detector stages, may therefore go largely unnoticed during typical operation. The overall dynamic range of the detection system may be maintained or improved, while effectively eliminating differential drift issues and maintaining acceptable detector lifetime.

Some embodiments of the present disclosure may include any combination of the following features: (1) a multi-mode digital/analog ion detector that (2) is configured to generate pulse counting signals having narrow output signal pulses with reduced or minimal signal "tailing" (e.g., less than 5 nsec wide pulses at 10% of the pulse height), (3) is configured to achieve long operational lifetime (e.g., greater than about 10 coulombs, for example, 100 coulombs, of accumulated current at the output of the detector), (4) is configured to generate a desired level of charge gain (e.g., two or more orders of magnitude higher than the analog stage, for example, $1\times10^7$or greater), (5) is configured to output pulse counting signals with a pulse rate of about $5\times10^7$ per second or greater without overheating or degradation, (6) includes signal handling electronics that provides reliable pulse separation with desired bandwidth for digital counting at higher pulse count rates, and (7) includes signal processing software and/or firmware to provide further functionality as described herein. In some embodiments, an ion detection system, meeting requirements (1) to (7) inclusive, may be configured to operate in the digital/pulse counting mode at pulse count rates of about 150 million cps (150 MHz) or more with excellent linearity, with signal capability to the equivalent of $1\times10^{10}$ cps including analog mode.

Embodiments of the present disclosure may thus provide a high-accuracy, effectively all-digital (with extended linear dynamic range analog mode) ion detection system. In typical uses (e.g., which may not analyze highly concentrated samples), embodiments of the present disclosure may be configured to operate without performing cross-calibration procedures to achieve highly accurate results across the entire measurement range. Embodiments of the present disclosure may thus simultaneously improve accuracy, stability, linearity and lifetime of mass spectrometer ion detector systems, with very infrequent detector cross-calibration required, improving instrument productivity and reducing cost of calibration standard solutions.

The flowchart and block diagrams shown in FIGS. 1 to 5 illustrate the architecture, functionality, and operation of possible implementations of systems, methods and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Figure 6:
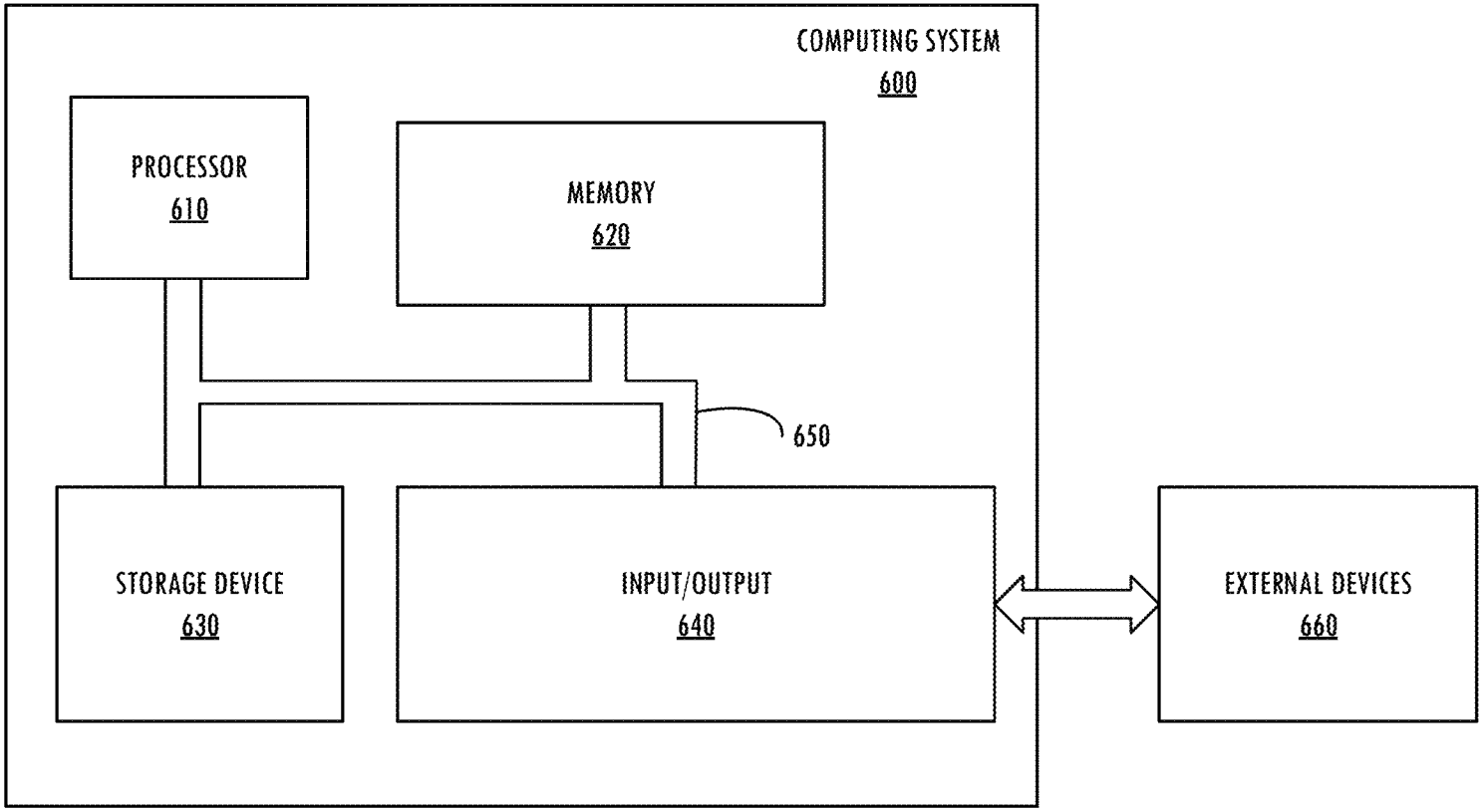
FIG. 6 is a schematic diagram illustrating an example computing system according to some embodiments of the present disclosure.

FIG. 6 shows an example computing system 600 that may be used to implement functionality and/or operations as described herein, for example, to implement one or more functions of the control circuit 114. The computing system 600 includes a processor 610, a memory 620, a storage device 630 and an input/output device 640. Each of the components 610, 620, 630 and 640 can be interconnected, for example, by a system bus 650. The processor 610 is configured to process instructions for execution within the system 600. In some embodiments, the processor 610 is a single-threaded processor, a multi-threaded processor, or another type of processor. The processor 610 is capable of processing instructions stored in the memory 620 or on the storage device 630. The memory 620 and the storage device 630 can store information within the system 600.

The input/output device 640 provides input/output operations for the system 600. In some embodiments, the input/output device 640 can include one or more of a network interface device, e.g., an Ethernet card, a serial communication device, e.g., an RS-232 port, and/or a wireless interface device, e.g., an 802.11 card, a 3G wireless modem, a 4G wireless modem, a 5G wireless modem, etc. In some embodiments, the input/output device can include driver devices configured to receive input data and send output data to other external devices 660, e.g., keyboard, printer and display devices. In some embodiments, mobile computing devices, mobile communication devices, and other devices can be used.

Aspects of the present disclosure may be implemented entirely hardware, entirely software (including firmware, resident software, micro-code, etc.) or combining software and hardware implementation that may all generally be referred to herein as a "circuit," "module," "component," or "system." For example, the control circuit(s) 114 described herein can be implemented using digital electronic circuitry, or in computer software, firmware, or hardware, or in combinations thereof. As another example, some or all of the operations shown in the processes 500*a*, 500*b* can be implemented using digital electronic circuitry, or in computer software, firmware, or hardware, or in combinations thereof.

Furthermore, aspects of the present disclosure may take the form of a computer program product including computer program instructions embodied as computer readable program code in one or more computer readable media. Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device. A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

Processors suitable for the execution of a computer program include, by way of example, both general and special purpose microprocessors, and processors of any kind of digital computer. Generally, a processor will receive instructions and data from a read only memory or a random access memory or both. A computer includes a processor for performing actions in accordance with instructions and one or more memory devices for storing instructions and data. A computer may also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non-volatile memory, media and memory devices, including by way of example semiconductor memory devices (e.g., EPROM, EEPROM, flash memory devices, and others), magnetic disks (e.g., internal hard disks, removable disks, and others), magneto optical disks, and CD-ROM and DVD-ROM disks. The processor and the memory can be supplemented by, or incorporated in, special purpose logic circuitry.

To provide for interaction with a user, operations can be implemented on a computer having a display device (e.g., a monitor, or another type of display device) for displaying information to the user and a keyboard and a pointing device (e.g., a mouse, a trackball, a tablet, a touch sensitive screen, or another type of pointing device) by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

As will be appreciated by one skilled in the art, aspects of the present disclosure may be illustrated and described herein in any of a number of patentable classes or context including any new and useful process, machine, manufacture, or composition of matter, or any new and useful improvement thereof.

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks. As used herein, "a processor" may refer to one or more processors.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

It will be further appreciated that the functionality of any or all of the program modules may also be implemented using discrete hardware components, one or more application specific integrated circuits (ASICs), or a programmed digital signal processor or microcontroller. The program code may execute entirely on a single processor and/or across multiple processors, as a stand-alone software package or as part of another software package. The program code may execute entirely on an electronic device or only partly on the electronic device and partly on another device. In the latter scenario, the other device may be connected to the electronic device through a wired and/or wireless local area network (LAN) and/or wide area network (WAN), or the connection may be made to an external computer (for example, through the Internet using an Internet Service Provider).

The present inventive concepts have been described herein with reference to the accompanying drawings, in which example embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly-formal sense unless expressly so defined herein.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments of the present invention described herein, and of the manner and process of making and using them, and shall support claims to any such combination or subcombination.

In the drawings and specification, there have been disclosed embodiments of the disclosure and, although specific terms are employed, they are used in a generic and descriptive sense only and not for purposes of limitation, the scope of the present invention being set forth in the following claims.

That which is claimed:

1. A mass spectrometry apparatus, comprising:

an ion detector comprising a pulse counting stage and an analog stage configured to generate a pulse counting signal and an analog signal, respectively, responsive to incident ions; and a control circuit coupled to the ion detector, wherein the control circuit is configured to output the pulse counting signal in a pulse counting output mode, and to output the analog signal in an analog output mode, wherein the control circuit is configured to switch from the pulse counting output mode to the analog output mode responsive to the pulse counting signal exceeding a first threshold, wherein the first threshold is within a range of about 10 million counts per second to about 200 million counts per second.

2. The mass spectrometry apparatus of claim 1, wherein the first threshold is within a range of about 30 million counts per second to about 150 million counts per second.

3. The mass spectrometry apparatus of claim 1, wherein the control circuit is configured to correct an accuracy of the pulse counting signal using a correction factor, and is configured to switch from the pulse counting output mode to the analog output mode based on the correction factor.

4. The mass spectrometry apparatus of claim 3, wherein the correction factor is based on a dead time of the pulse counting signal, and wherein the control circuit is configured to switch from the pulse counting output mode to the analog output mode when the correction factor is about 1.5 or more.

5. The mass spectrometry apparatus of claim 1, wherein the ion detector and/or the control circuit is configured to provide the pulse counting signal having a pulse width of less than about 5 nanoseconds at about half of a pulse amplitude of the pulse counting signal.

6. The mass spectrometry apparatus of claim 5, wherein the ion detector and/or the control circuit is configured to provide the pulse width of less than about 5 nanoseconds at about a tenth of the pulse amplitude.

7. The mass spectrometry apparatus of claim 1, wherein the pulse counting signal comprises an output current of greater than about 30 microamperes.

8. The mass spectrometry apparatus of claim 1, wherein a charge transfer capability of the ion detector is greater than about 1 coulomb.

9. The mass spectrometry apparatus of claim 8, wherein the analog stage is configured to provide a first gain, and wherein the pulse counting stage is configured to provide a second gain that is two or more orders of magnitude higher than the first gain.

10. The mass spectrometry apparatus of claim 9, wherein the analog stage comprises a first plurality of dynodes, and wherein the pulse counting stage comprises at least one avalanche diode.

11. The mass spectrometry apparatus of claim 9, wherein the control circuit is configured to reduce the second gain of the pulse counting stage or deactivate the pulse counting stage responsive to the analog signal exceeding a second threshold that is greater than the first threshold.

12. The mass spectrometry apparatus of claim 1, wherein the control circuit is configured to prevent cross-calibration of the pulse counting and analog signals responsive to the pulse counting signal indicating less than about $2\times10^5$ counts per second.

13. The mass spectrometry apparatus of claim 1, wherein the first threshold is based on an accuracy of the pulse counting signal and is independent of an accuracy of the analog signal.

14. The mass spectrometry apparatus of claim 1, further comprising:

a quadrupole mass analyzer in an ion path between an ion source and the ion detector.

15. The mass spectrometry apparatus of claim 1, wherein the mass spectrometry apparatus is an inductively coupled plasma system.

16. An apparatus, comprising:

an ion detector comprising a pulse counting stage and an analog stage configured to generate a pulse counting signal and an analog signal, respectively, responsive to incident ions; and a control circuit coupled to the ion detector, wherein the control circuit is configured to output the pulse counting signal in a pulse counting output mode, and to output the analog signal in an analog output mode, wherein the control circuit is configured to correct an accuracy of the pulse counting signal using a correction factor, and is configured to switch from the pulse counting output mode to the analog output mode based on the correction factor.

17. The apparatus of claim 16, wherein the control circuit is configured to switch from the pulse counting output mode to the analog output mode responsive to the correction factor exceeding a threshold, wherein the threshold is about 1.5 or more.

18. The apparatus of claim 17, wherein the threshold is based on a dead time of the pulse counting signal.

19. The apparatus of claim 18, wherein the threshold corresponds to a corrected pulse count rate within a range of about 10 million counts per second to about 200 million counts per second.

20. The apparatus of claim 19, wherein the ion detector and/or the control circuit is configured to provide the pulse counting signal having a pulse width of less than about 5 nanoseconds at about half of a pulse amplitude of the pulse counting signal, and wherein the threshold is based on the pulse width.

21. The apparatus of claim 17, wherein the threshold is about 2.5 or more.

22. The apparatus of claim 16, wherein the correction factor is independent of an accuracy of the analog signal.

23. A method, comprising:

performing, by a control circuit, operations comprising:

receiving, from an ion detector, pulse counting and analog signals generated by pulse counting and analog stages thereof, respectively, responsive to incident ions; and switching from a pulse counting output mode for output of the pulse counting signal to an analog output mode for output of the analog signal responsive to the pulse counting signal exceeding a first threshold, wherein the first threshold is within a range of about 10 million counts per second to about 200 million counts per second.

24. The method of claim 23, wherein the control circuit is configured to correct an accuracy of the pulse counting signal using a correction factor, and is configured to switch from the pulse counting output mode to the analog output mode based on the correction factor.

25. The method of claim 24, wherein the correction factor is based on a dead time of the pulse counting signal, and wherein the control circuit is configured to switch from the pulse counting output mode to the analog output mode when the correction factor is about 1.5 or more.

26. The method of claim 23, wherein the first threshold is within a range of about 30 million counts per second to about 150 million counts per second.

27. The method of claim 23, wherein the ion detector and/or the control circuit is configured to provide the pulse counting signal having a pulse width of less than about 5 nanoseconds at about half of a pulse amplitude of the pulse counting signal.

28. The method of claim 23, wherein the pulse counting signal comprises an output current of greater than about 30 microamperes.

29. The method of claim 23, wherein a charge transfer capability of the ion detector is greater than about 1 coulomb.

30. The method of claim 23, wherein the analog stage is configured to provide a first gain, and wherein the pulse counting stage is configured to provide a second gain that is two or more orders of magnitude higher than the first gain.

31. The method of claim 30, wherein the analog stage comprises a first plurality of dynodes, and wherein the pulse counting stage comprises at least one avalanche diode.

32. The method of claim 23, wherein the first threshold is based on an accuracy of the pulse counting signal and is independent of an accuracy of the analog signal.

* * * * *